US005570991A

United States Patent [19]

Swenson et al.

[11] Patent Number: 5,570,991

[45] Date of Patent: Nov. 5, 1996

[54] SWING LOCK FOR A BACKHOE

[75] Inventors: Larry E. Swenson; Michael A. Vig; Thomas M. Sagaser; Troy D. Kraft, all of Bismarck, N. Dak.

[73] Assignee: Clark Equipment Company, Woodcliff Lake, N.J.

[21] Appl. No.: 403,003

[22] Filed: Mar. 9, 1995

[51] Int. Cl.[6] ..... B66C 23/00

[52] U.S. Cl. ..... 414/685; 414/686; 414/689; 91/445

[58] Field of Search ..... 91/445; 414/685, 414/686, 689, 694

[56] References Cited

U.S. PATENT DOCUMENTS

| | | | |
|---|---|---|---|
| 2,878,784 | 3/1959 | Pilch | 91/445 |
| 3,453,937 | 7/1969 | Haberman | 92/5 |
| 3,734,320 | 5/1973 | Redenbarger . | |
| 3,811,582 | 5/1974 | Shumaker et al. . | |
| 3,921,835 | 11/1975 | Baker et al. . | |
| 3,943,824 | 3/1976 | Fletcher | 91/445 |
| 3,943,825 | 3/1976 | Bianchetta | 91/445 |
| 4,015,729 | 4/1977 | Parquet et al. . | |
| 4,065,010 | 12/1977 | Worback . | |
| 4,267,767 | 5/1981 | Holdapp et al. | 91/445 |
| 4,273,502 | 6/1981 | Maurer et al. | 414/694 |
| 4,370,090 | 1/1983 | Shumaker et al. | 414/694 |
| 4,389,153 | 6/1983 | Pedersen et al. | 414/695.5 |
| 4,594,487 | 6/1986 | Grassl et al. | 200/82 E |
| 4,608,911 | 9/1986 | Johnson | 91/445 |
| 4,735,547 | 4/1988 | Wagner et al. | 414/686 |
| 4,767,255 | 8/1988 | Mickelson et al. | 414/695.5 |
| 4,836,740 | 6/1989 | Wagner | 414/686 |
| 4,997,333 | 3/1991 | Ball et al. | 414/694 |
| 5,006,033 | 4/1991 | McConnell | 91/445 |
| 5,153,348 | 8/1992 | Kishi et al. | 414/695.8 |
| 5,179,887 | 1/1993 | Leinen et al. | 91/387 |
| 5,308,220 | 5/1994 | Shaeff | 414/699 |

*Primary Examiner*—David A. Bucci
*Assistant Examiner*—Gregory A. Morse
*Attorney, Agent, or Firm*—Westman, Champlin & Kelly, P.A.

[57] ABSTRACT

The present invention provides a control apparatus for controlling movement of an implement. The implement is mounted to a subframe that in turn is joined to a frame portion of the vehicle. The subframe is moveable between the working position, where the implement is operable to perform work, and a second position. The implement has a hydraulic actuator for selectively moving a portion of the implement to perform work using controlled hydraulic fluid present in a hydraulic line connected to the hydraulic actuator. The control apparatus inhibits or allows hydraulic fluid flow in the hydraulic line as a function of the position of the subframe.

11 Claims, 4 Drawing Sheets

SWING LOCK FOR A BACKHOE

BACKGROUND OF THE INVENTION

The present invention relates to moveable power machinery. More particularly, the present invention relates to an apparatus for controlling movement of a backhoe mounted on a vehicle.

Various types of implements have been designed to be mounted to vehicles thereby making the implement very versatile since it can be transported to the construction site. Backhoes are one such common implement and have been mounted to various vehicles such as tractors, articulated loaders and skid steer loaders. U.S. Pat. No. 4,836,740 discloses a pivotal attachment that allows a backhoe to be mounted to an articulated loader. The backhoe includes a subframe that is pivotally connected to a main frame of the vehicle about a transverse axis near one end of the main frame. An actuator is provided for selectively pivoting the backhoe mounting subframe between a working position and a transport position. Pivoting the backhoe and its subframe mounting to the working position allows the lowest part of the subframe and also the backhoe to be closer to the ground. Since the backhoe is located closer to the ground, it can dig deeper than previously known backhoes with the same length boom and dipper stick. In addition, when the backhoe is in the transport position, the center of gravity of the backhoe is farther forward than when it is in the working position. This transfers more of the backhoe weight toward the front of the machine giving the machine excellent balance which allows the operator to drive the machine on the highway at transport speed without undue bouncing.

SUMMARY OF THE INVENTION

The present invention arises from the desire to inhibit selected movements of the implement and maintain it in a stationary position when the implement is no longer in a working position. Thus, the present invention provides a control apparatus for controlling movement of an implement. The implement is mounted to a subframe that in turn is joined to a frame. The subframe is moveable between the working position where the implement is operable to perform work and a second position. The implement has a hydraulic actuator for selectively moving a portion of the implement to perform work using controlled hydraulic fluid present in a hydraulic line connected to the hydraulic actuator. The control apparatus inhibits or allows hydraulic fluid flow in the hydraulic line as a function of the position of the subframe.

In the embodiment described, the implement is a backhoe which is mounted to vehicle frame. The control apparatus includes a sensor and a fluid control device. The sensor senses placement of the subframe in the working position and provides an output signal representing when the subframe has been placed in the working position. The fluid control device is joined to the hydraulic line and operably connected to the sensor to receive the output signal. The fluid control device selectively controls fluid flow to the hydraulic actuator as a function of the output signal.

DETAILED DESCRIPTION OF THE PREFERRED EMBODIMENTS

Figure 1:
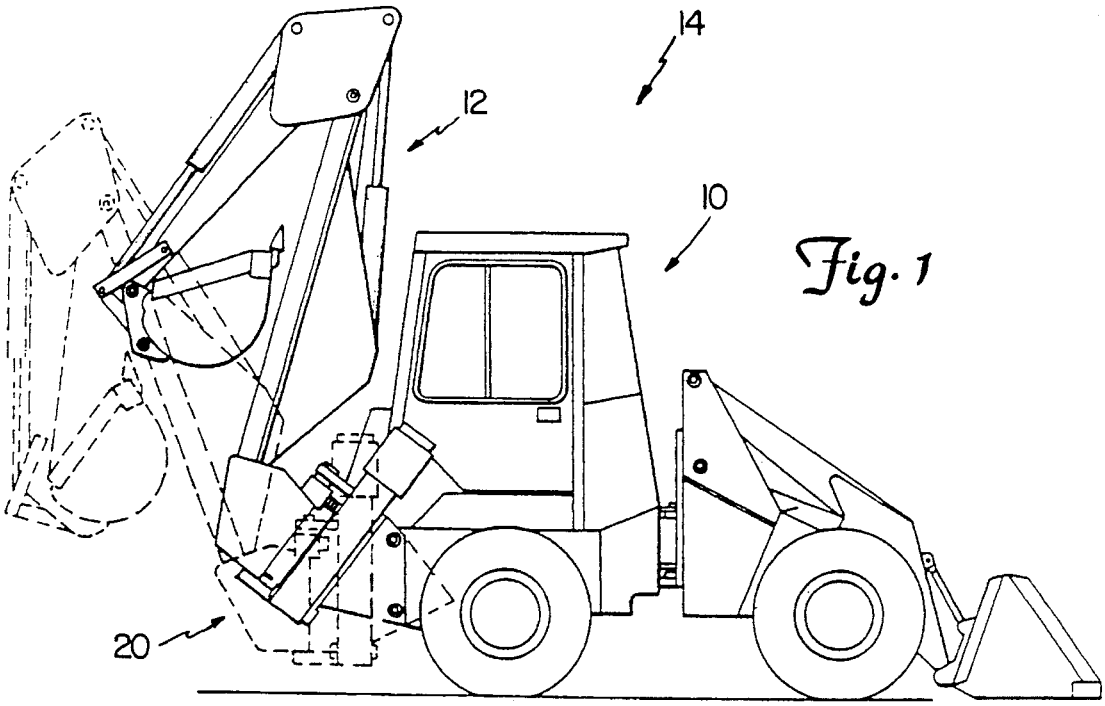
FIG. 1 is a side elevational view of a vehicle having a backhoe.
Figure 2:
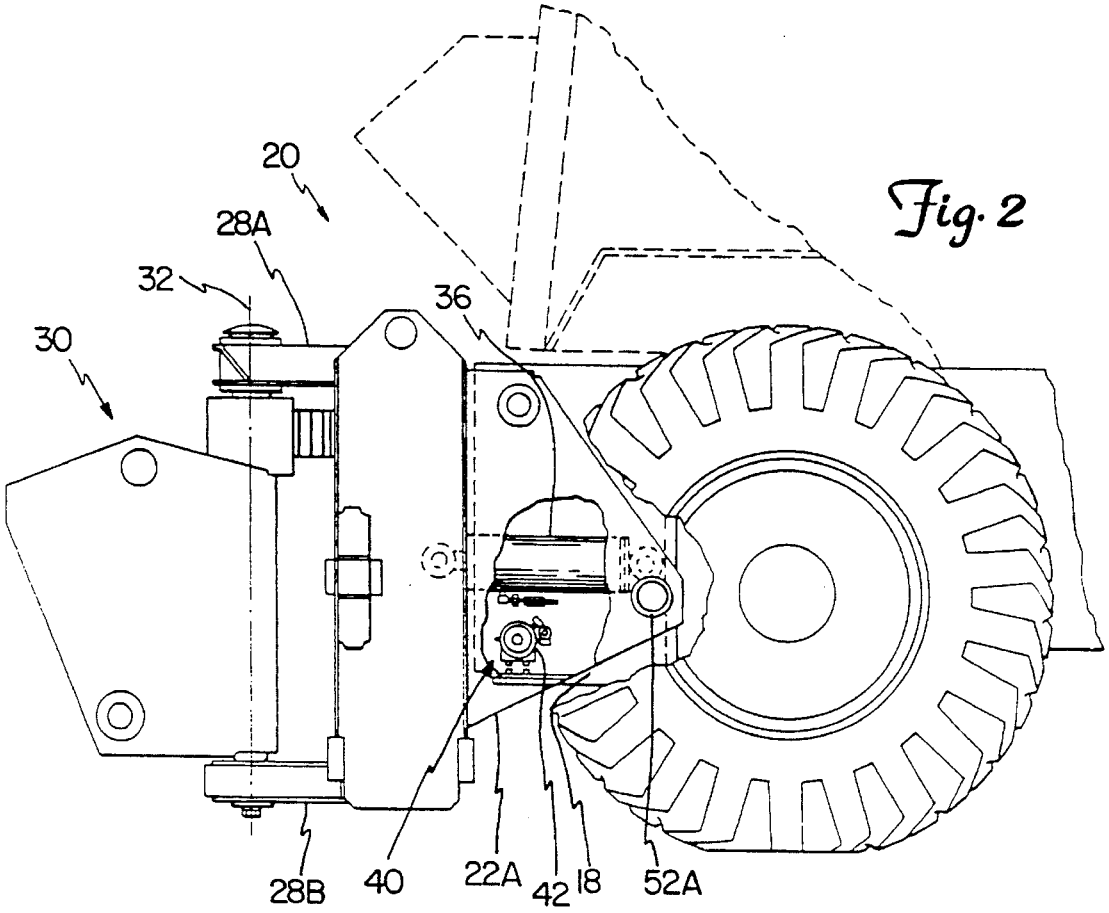
FIG. 2 is a partial side elevational view of the vehicle and backhoe placed in a working position.
Figure 3:
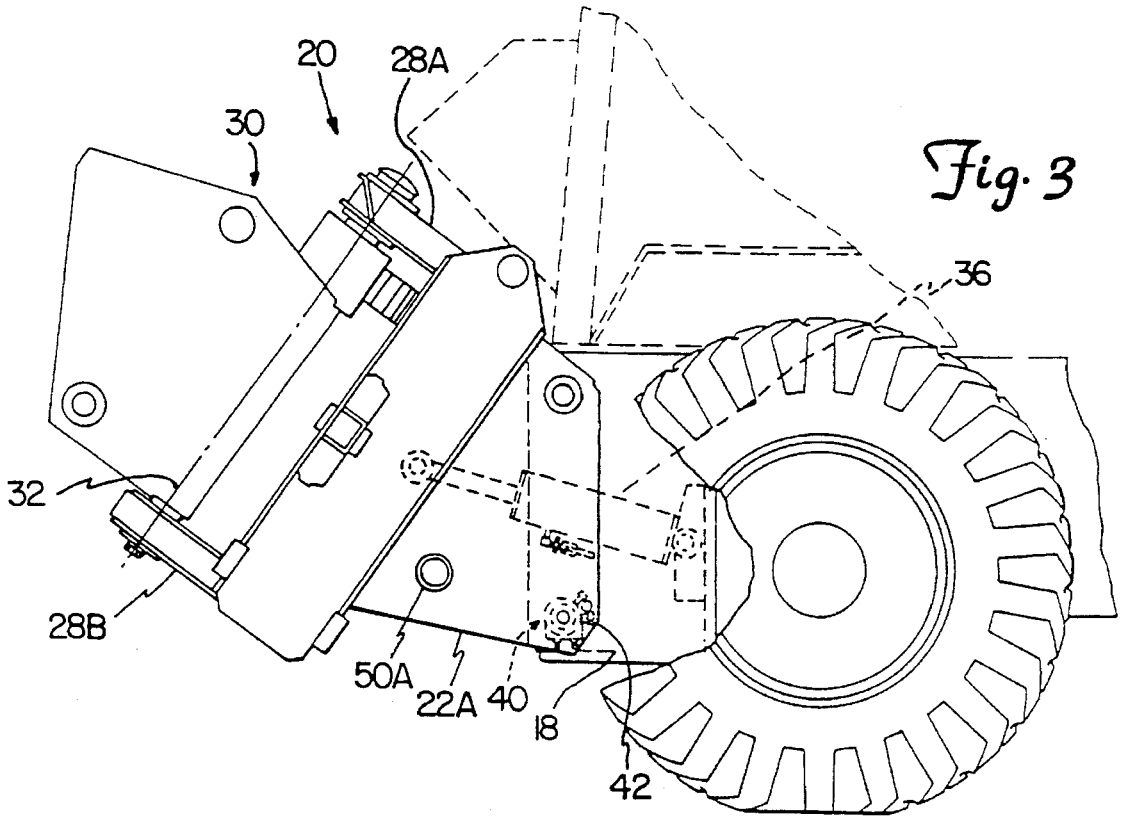
FIG. 3 is a partial side elevational view of the vehicle and backhoe placed in a transport position.
Figure 4:
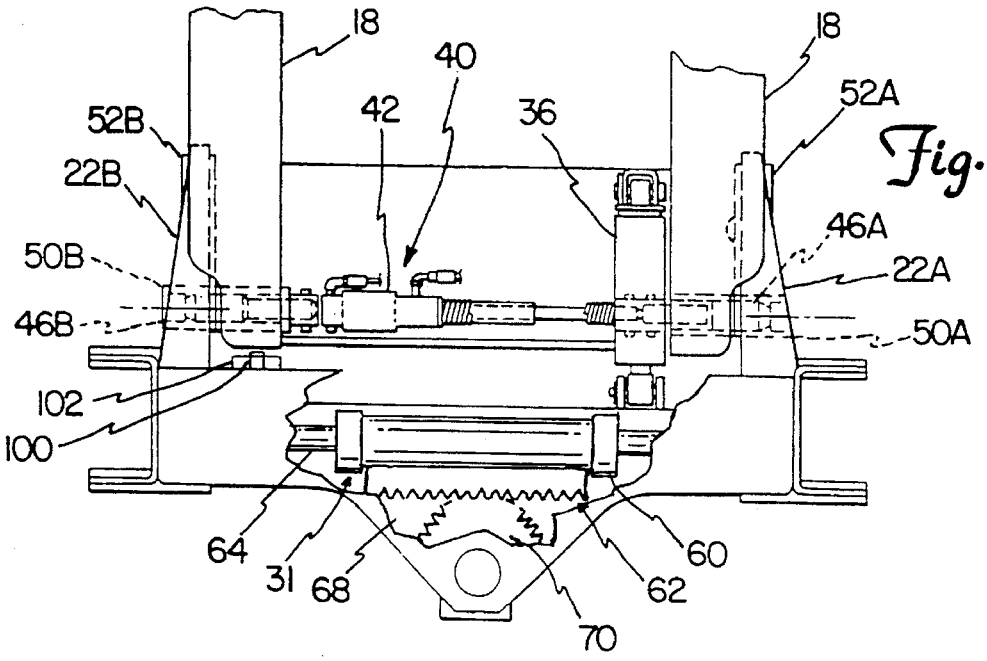
FIG. 4 is a partial top plan view of the vehicle and the backhoe.

FIG. 1 is a side elevational view of a vehicle 10 having an implement (backhoe) 12 mounted thereto to form an excavator machine, which is designated in its entirety by numeral 14. The vehicle 10 includes a main frame 18, portions of which are seen in FIGS. 2, 3 and 4. Referring back to FIG. 1, a backhoe mounting subframe 20 is pivotally mounted on the frame 18 to pivot the backhoe 12 between a transport position illustrated in solid lines and a working position illustrated in dashed lines. As illustrated in FIGS. 2, 3 and 4, the subframe 20 includes a pair of forwardly extending vertical brackets 22A and 22B connected to two sides of the frame 18 to pivot the subframe 20 on the frame 18 about an axis 24. The axis 24 is formed by a pair of pivot pins 26A and 26B on opposite sides of the vehicle 10 and the subframe 20.

FIG. 2 illustrates the subframe 20 in the working position. In this condition, a hydraulic actuator 36, which connects between the subframe 20 and the frame 18, is retracted causing the subframe 20 to be pivoted to its lower most or working position. When the actuator 36 is extended, the subframe 20 is pivoted upwardly and outwardly to the transport position illustrated in FIG. 3. A transverse latching device 40 mounted on the frame 18, which is illustrated in FIGS. 2–4, is operable by the vehicle operator to latch the subframe 20 to the frame 18. The latching device 40 is shown in the latched condition in FIG. 4. The latching device 40 includes a hydraulic actuator 42, which is extended to latch the subframe 20 to the frame 18 and retracted to accomplish unlatching. Pins 46A and 46B at opposite ends of the latching device 40 extend into openings 50A and 50B, respectively, in the brackets 22A and 22B, respectively, on the opposite sides of the subframe 20 when the backhoe 12 is in the working position. There is another pair of openings 52A and 52B in brackets 22A and 22B, respectively, into which the pins 46A and 46B project when the machine is in the transport or raised position, as illustrated in FIG. 3.

Figure 5:
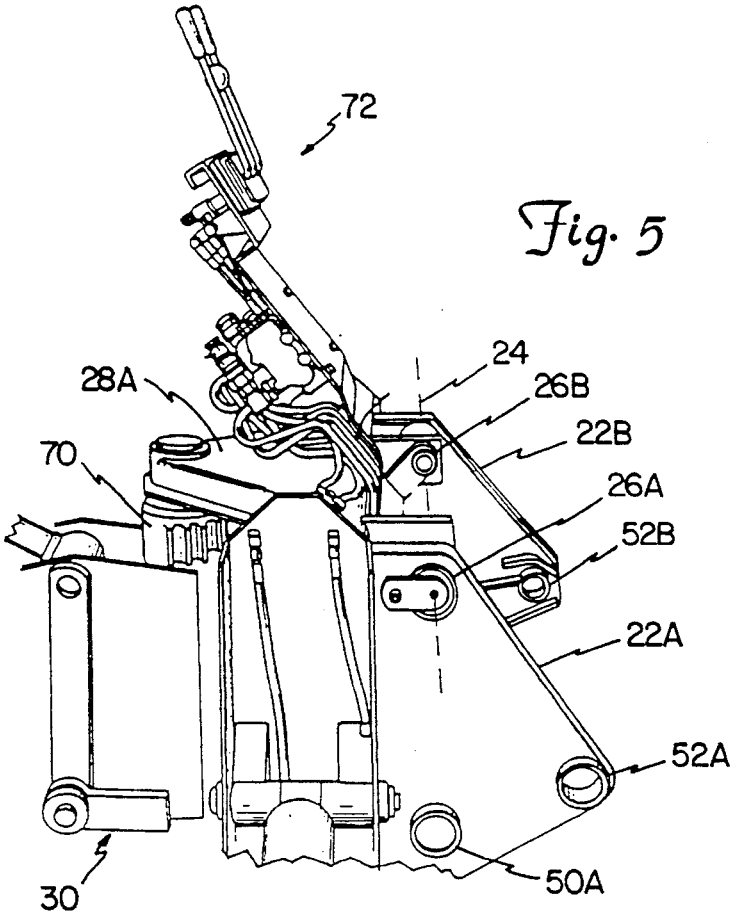
FIG. 5 is a perspective view of a portion of the backhoe from the same side as FIG. 1.

The subframe 20 also includes a pair of rearwardly extending upper and lower horizontally disposed bracket portions 28A and 28B, as illustrated in FIGS. 2 and 3. The brackets 28A and 28B support a swing frame 30 having a pivot axis 32. The swing frame 30 allows the backhoe 12, which is mounted on the swing frame 30, to pivot through an arc of almost 180 degrees from one side of the machine 14 to the other. A dual-acting hydraulic swing actuator 31 controls pivotal movement of the backhoe 12 about the pivot axis 32. The swing actuator 31 includes a cylinder 60 having teeth 62 mounted on an outer surface and a fixed piston rod 64 mounted between and to the brackets 22A and 22B. The teeth 62 mesh with teeth 68 on a gear sector 70 connected between the horizontal brackets 28A and 28B. An operator control apparatus 72, illustrated in FIG. 5, provides controlled hydraulic fluid to the swing actuator 31 through a hydraulic circuit comprising hydraulic pressure lines 74A and 74B to drive the cylinder 60 selectively toward one end of the piston rod 64 or the other. As the cylinder 60 is displaced linearly on the piston rod 64, the gear sector 70 and the backhoe 12 are pivoted about the pivot axis 32.

Figure 6:
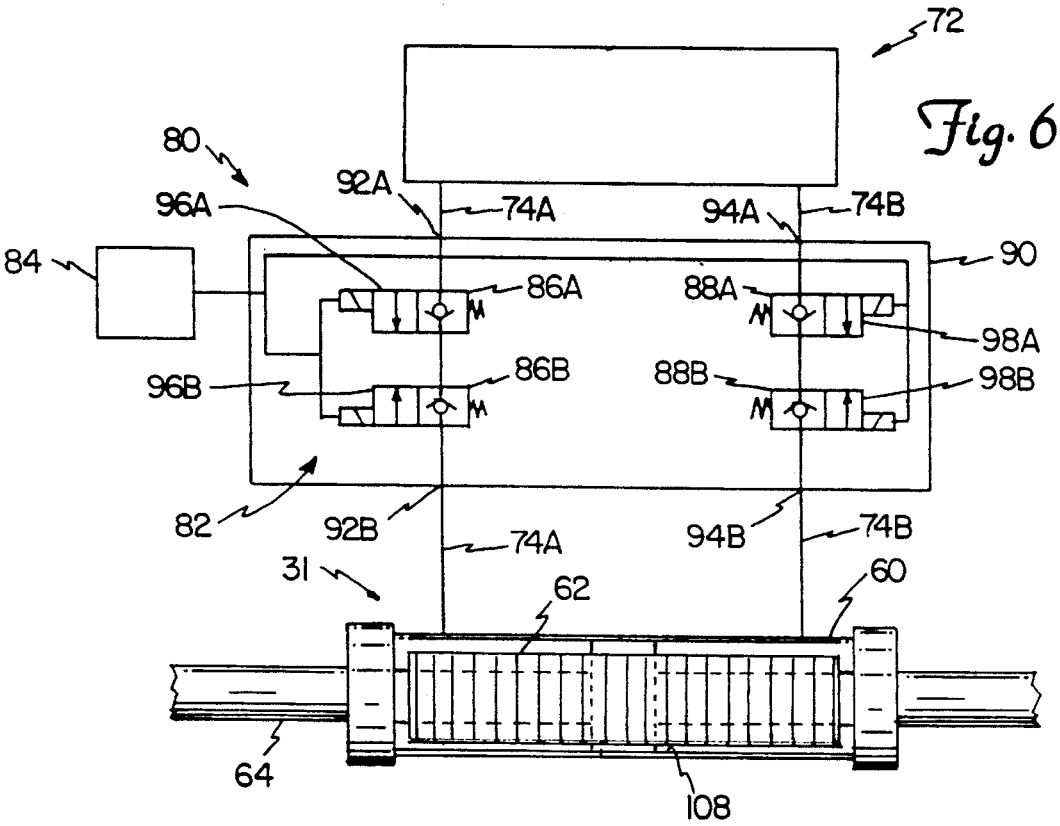
FIG. 6 is a schematic diagram of a control apparatus of the present invention used to control swing movement of the backhoe.

Referring to FIG. 6, a control apparatus 80 of the present invention includes a fluid control device 82 that is locatable in the hydraulic circuit for the swing actuator 31 and a sensing device 84 that senses the position of the subframe 20 and controls the fluid control device 82 based on the position of the subframe 20. As illustrated, the pressure lines 74A and 74B connect the operator control apparatus 72 to the swing actuator 31. The fluid control device 82 is connected to the pressure lines 74A and 74B to control fluid flow to the swing actuator 31 wherein flow is blocked when the subframe 20 is not in the working position.

In the embodiment illustrated, the fluid control device 82 comprises two pairs of series-connected check valves 86A, 86B and 88A, 88B that are fluidly connected to pressure lines 74A and 74B, respectively, to selectively inhibit or allow fluid flow therein. Check valves 86A, 86B, 88A and 88B are mounted to a manifold block 90 having suitable passageways formed therein with ports 92A, 92B, 94A and 94B that are connectable to the pressure lines 74A and 74B. The check valves 86A and 88A block fluid flow to the swing actuator 31, while the check valves 86B and 88B block fluid flow from the swing actuator 31. In the embodiment illustrated, the check valves 86A, 86B, 88A and 88B are electrically operated, having suitable electric solenoid actuators 96A, 96B, 98A and 98B, respectively. The solenoid actuators 96A, 96B, 98A and 98B are each connected to the sensor device 84, while a suitable connector 85 (FIG. 7) is provided to obtain electrical power from the vehicle to operate the sensing device 84 and the solenoid actuators 96A, 96B, 98A and 98B.

Figure 7:
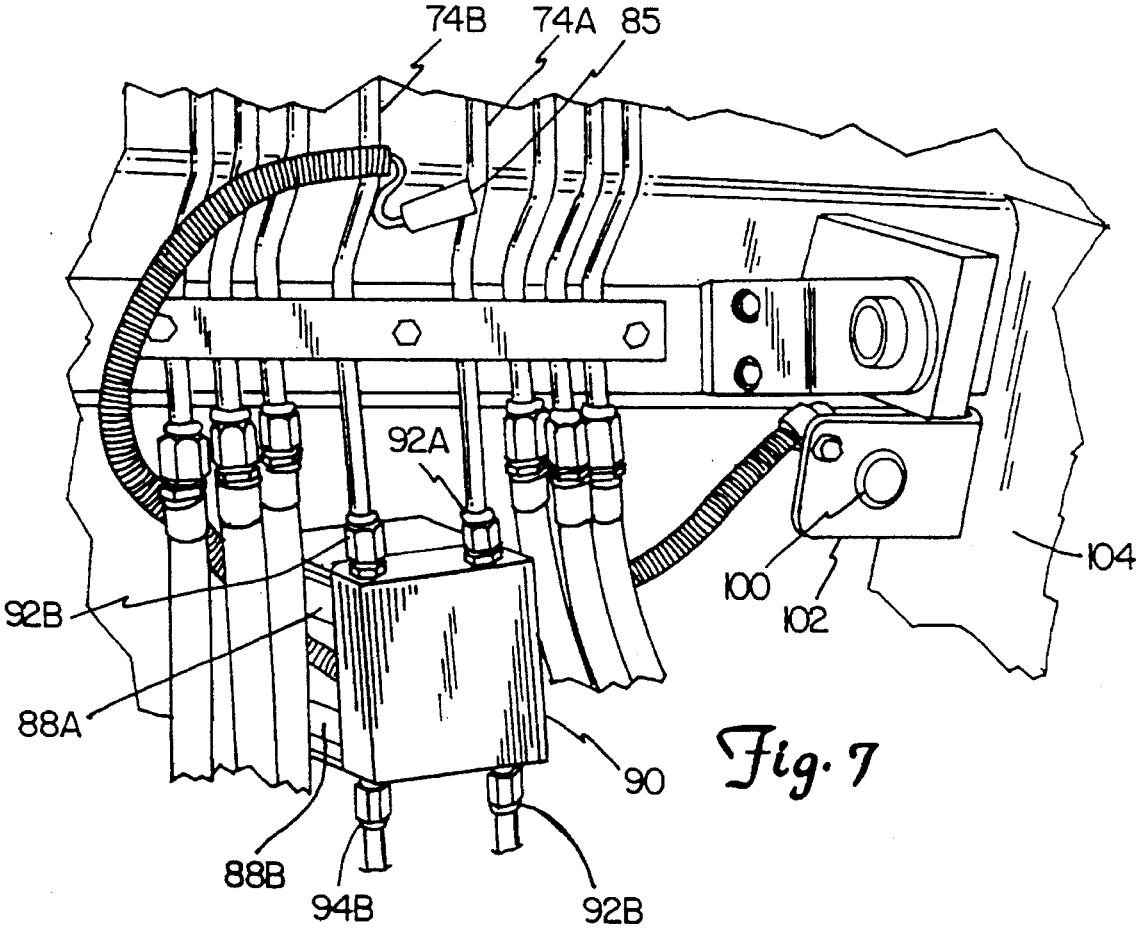
FIG. 7 is a partial front perspective view of the control apparatus mounted to the backhoe.
Figure 8:
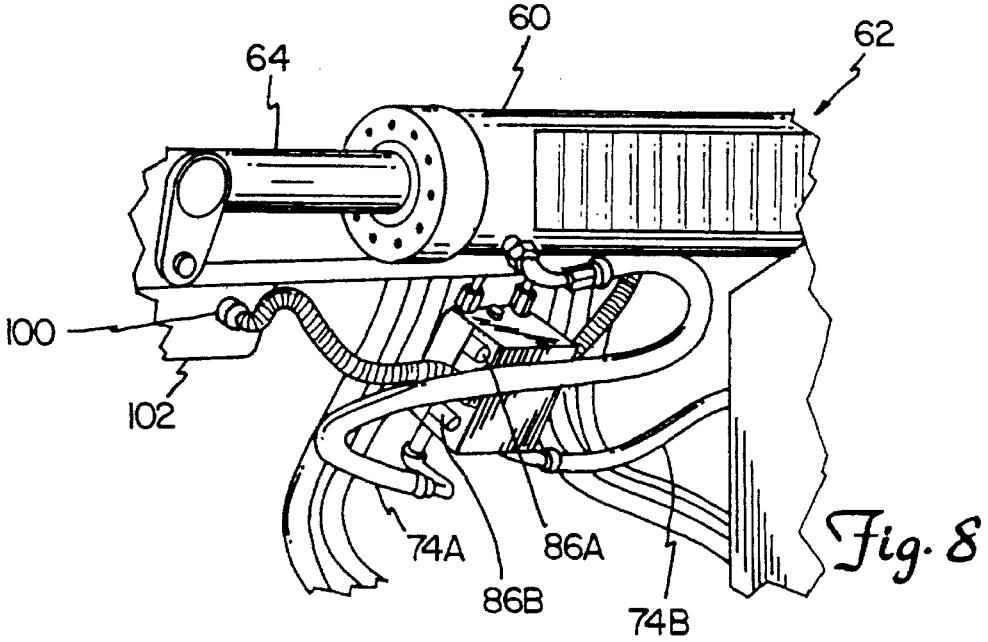
FIG. 8 is a partial rear perspective view of the control apparatus mounted to the backhoe.

In the embodiment illustrated, the sensing device 84 comprises a proximity sensor 100 which senses the frame 18 when a portion of the subframe 20 is pivoted adjacent to the frame 18. As illustrated in FIG. 7, the proximity sensor 100 is mounted to a bracket 102 which in turn is securely fixed to a pivotal portion 104 of the subframe 20. When the subframe 20 is placed in the working position, the proximity sensor 100 provides a suitable electric control signal to each solenoid actuator 96A, 96B, 98A and 98B to open the check valves 86A, 86B, 88A and 88B and allow fluid flow between the operator control apparatus 72 and the swing actuator 31. However, when the subframe 20 is pivoted from the working position, the control signal is turned off, causing the solenoid actuators 96A, 96B, 98A and 98B to become de-energized so that the check valves 86A, 86B, 88A and 88B block fluid flow to the swing actuator 31. By blocking fluid flow through the pressure lines 74A and 74B, fluid volumes on each side of a piston 108 in the cylinder 60 (FIG. 6) are held constant thereby preventing the cylinder 60 from moving relative to the piston 108.

As appreciated by those skilled in the art, other types of sensors can be used in place of the proximity sensor 100. For instance, a suitable linear displacement sensor can used to measure extension of the hydraulic actuator 36. Likewise, a suitable sensor can be used to monitor activation of the hydraulic actuator 42 to lock the subframe 20 in the working position.

In summary, the control apparatus 80 of the present invention senses the position of the backhoe 12 as it is moved from and to the working position. When the backhoe 12 is placed in the working position, normal fluid flow is allowed to swing the backhoe 12. However, when the backhoe 12 is pivoted from the working position, fluid flow is blocked and the backhoe 12 is held in a stationary position. Although the invention has been described with reference to a backhoe mounted to an articulated loader, it should be understood that the present invention can be used with other implements that are mounted to other vehicles. For instance, the present invention is also well suited for backhoes or other implements mounted to skid steer loaders.

Although the present invention has been described with reference to preferred embodiments, workers skilled in the art will recognize that changes may be made in form and detail without departing from the spirit and scope of the invention.

What is claimed is:

1. A control apparatus for controlling movement of an implement, the implement having a frame and a subframe mounted to the frame, the subframe being moveable from a working position, where the implement is operable to perform work, to a second position, and a hydraulic actuator for selectively moving a portion of the implement to perform work using controlled hydraulic fluid present in a hydraulic line connected to the hydraulic actuator, the control apparatus comprising:

sensing means for sensing placement of the subframe in the working position and providing an output signal representing when the subframe has been placed in the working position; and fluid control means for receiving the output signal and for controlling fluid flow to the hydraulic actuator as a function of the output signal, the fluid control means comprising an operator actuated valve and a pair of check valves operated as a function of the output signal and connected in series in the hydraulic line between the operator actuated valve and the hydraulic actuator, wherein first check valve interrupts fluid flow to the hydraulic actuator and a second check valve interrupts fluid flow from the hydraulic actuator.

2. The control apparatus claim 1 wherein the hydraulic actuator comprises a dual acting hydraulic actuator having a first actuator port and a second actuator port, the first-mentioned hydraulic line being connected to the first actuator port and a second hydraulic line being connected to the second actuator port, and the fluid control means further comprises a second pair of check valves operated as a function of the output signal and connected in series in the second hydraulic line wherein a third check valve interrupts fluid flow to the second actuator port and a fourth check valve interrupts fluid flow from the second actuator port.

3. The control apparatus of claim 1 wherein the sensing means comprises a proximity sensor.

4. A kit for a hydraulic control circuit used to control movement of an implement, the implement having a frame and a subframe mounted to the frame, the subframe being moveable from a working position, where the implement is operable to perform work, to a second position, and a hydraulic control circuit comprising and operator actuated control panel connected to a hydraulic actuator used to perform work, the operator actuator control panel controlling pressurized fluid provided to the hydraulic actuator with a hydraulic line, and the kit comprising:

a sensor to sense placement of the subframe in the working position and provide an output signal representing when the subframe has been placed in the working position; and a fluid control device joinable to the hydraulic line to control fluid flow therein and operably connected to the sensor to receive the output signal, the fluid control device comprising a pair of check valves operated as a function of the output signal and connectable in series in the hydraulic line between the operator actuated control panel and the hydraulic actuator, wherein a first check valve interrupts fluid flow to the hydraulic actuator and a second check valve interrupts fluid flow from the hydraulic actuator.

5. The kit of claim 4 wherein the hydraulic actuator comprises a dual-acting hydraulic actuator having a first actuator port and a second actuator port, the first-mentioned hydraulic line being connected to the first actuator port and a second hydraulic line being connected to the second actuator port, and the fluid control device further comprises a second pair of check valves operated as a function of the output signal and connectable in series in the second hydraulic line wherein a third check valve interrupts fluid flow to the second actuator port and a fourth check valve interrupts fluid flow from the second actuator port.

6. The kit of claim 5 wherein the sensor comprises a proximity sensor.

7. The kit of claim 6 and a bracket mountable to the subframe for movement therewith, the proximity sensor being securable to the bracket.

8. An implement comprising:

a frame;

a subframe mounted to the frame, the subframe being moveable from a working position, where the implement is operable to perform work, to a second position;

a hydraulic actuator for selectively moving a portion of the implement to perform work using controlled hydraulic fluid present in a hydraulic line connected to the hydraulic actuator;

a sensor to sense placement of the implement in the working position and provide an output signal representing when the implement has been placed in the working position; and a fluid control device joined to the hydraulic line and operably connected to the sensor to receive the output signal wherein the fluid control device selectively controls fluid flow to the hydraulic actuator as a function of the output signal, the fluid control device comprising an operator actuated valve and a pair of check valves operated as a function of the output signal and connected in series in the hydraulic line between the operator actuated valve and the hydraulic actuator, wherein a first check valve interrupts fluid flow to the hydraulic actuator and a second check valve interrupts fluid flow from the hydraulic actuator.

9. The implement of claim 8 wherein the hydraulic actuator comprises a dual-acting hydraulic actuator having a first actuator port and a second actuator port, the first-mentioned hydraulic line being connected to the first actuator port and a second hydraulic line being connected to the second actuator port, and the fluid control device further comprises a second pair of check valves operated as a function of the output signal and connected in series in the second hydraulic line wherein a third check valve interrupts fluid flow to the second actuator port and a fourth check valve interrupts fluid flow from the second actuator port.

10. The implement of claim 9 wherein the sensor comprises a proximity sensor.

11. The implement of claim 10 and a bracket mountable to the subframe for movement therewith, the proximity sensor being secured to the bracket.

* * * * *

UNITED STATES PATENT AND TRADEMARK OFFICE

CERTIFICATE OF CORRECTION

PATENT NO. : 5,570,991

DATED : November 5, 1996

INVENTOR(S) : Swenson et al.

It is certified that error appears in the above-indentified patent and that said Letters Patent is hereby corrected as shown below:

Cover Page: Item

[56] References Cited

Reference 21, replace "5,153,348" with --5,135,348--.

Column 4, line 46, replace "dual acting" with --dual-acting--.

Signed and Sealed this

Fourth Day of March, 1997

*Attest:*

*Attesting Officer*

BRUCE LEHMAN

*Commissioner of Patents and Trademarks*